United States Patent [19]

Rothwarf et al.

[11] 4,224,067

[45] Sep. 23, 1980

[54] PERMANENT MAGNET MATERIALS

[75] Inventors: Frederick Rothwarf, Toms River; Robert L. Bergner, Randolph; Herbert A. Leupold, Eatontown; Arthur Tauber, Elberon, all of N.J.

[73] Assignee: The United States of America as represented by the Secretary of the Army, Washington, D.C.

[21] Appl. No.: 33,911

[22] Filed: Apr. 27, 1979

[51] Int. Cl.[3] ..... C22C 19/00

[52] U.S. Cl. ..... 75/170; 75/134 M; 75/152

[58] Field of Search ..... 75/134 M, 152, 170; 148/31.57, 101, 102

[56] References Cited

U.S. PATENT DOCUMENTS

| | | | |
|---|---|---|---|
| 3,615,911 | 10/1971 | Nesbitt et al. | 148/31.57 |
| 3,723,197 | 3/1973 | Buschow et al. | 148/101 |
| 3,887,395 | 6/1975 | Martin | 148/31.57 |
| 3,901,741 | 8/1975 | Benz et al. | 148/101 |
| 3,997,371 | 12/1976 | Tokunaga et al. | 75/152 |

OTHER PUBLICATIONS

"Temperature Dependence of the Magnetic Parameters in the $Sm_{2-x}Gd_xCo_{17-y}Mn_y$ Compounds", Bergner et al., paper presented Nov. 15, 1978, at 24th annual Conference on Magnetism and Magnetic Materials, Cleveland, Ohio.

*Primary Examiner*—L. Dewayne Rutledge
*Assistant Examiner*—John P. Sheehan
*Attorney, Agent, or Firm*—Nathan Edelberg; Jeremiah G. Murray; Roy E. Gordon

[57] ABSTRACT

Compounds of the general formula $Sm_{2-x}RE_xCo_{17-y}Mn_y$ are provided wherein RE is a rare earth element selected from the group consisting of erbium, dysprosium and gadolinium wherein x has a value greater than zero and less than 0.7 and wherein y has a value less than 2.1. The compounds are suitable for use as permanent magnet material in microwave/millimeter-wave traveling wave tubes (TWT's).

22 Claims, No Drawings

PERMANENT MAGNET MATERIALS

The invention described herein may be manufactured, used, and licensed by or for the Government for governmental purposes without the payment to us of any royalty thereon.

This invention relates in general to new and useful compounds of the general formula $Sm_{2-x}RE_xCo_{17-y}Mn_y$ wherein RE is a heavy rare earth element, wherein x has a value greater than zero and less than 0.7, and wherein y has a value less than 2.1; and in particular to the use of these compounds as high-energy product, low temperature coefficient permanent magnet materials suitable for use in millimeter wave/microwave devices. This application is copending with U.S. patent application Ser. No. 033,940 filed Apr. 27, 1979 for "Method of Treating a Permanent Magnet Alloy" and with U.S. patent application Ser. No. 033,939 filed Apr. 27, 1979 for "Magnetic Alloys", the aforesaid applications being filed concurrently herewith and being assigned to a common assignee.

BACKGROUND OF THE INVENTION

There are a variety of millimeter wave/microwave devices, as for example traveling wave tubes (TWT's) which require high-energy product, low-temperature coefficient permanent magnet materials. In such devices, the air gap flux density must be maintained constant over a wide temperature range. Since the magnetizations of Alnico, hard ferrite and the available rare earth-cobalt permanent magnet materials decrease with increasing temperature, one must compensate in some way for the magnetization changes. One method involves shunting the flux in the room temperature range by the addition of external shims attached to the magnets. The shim is made from an alloy, usually 30 percent NiFe, which has a Curie temperature slightly above room temperature. Thus, as the temperature increases, less flux is shunted and the flux density in the gap is maintained constant. However, the placement of the compensating shunts is an expensive, tedious, manual process. The addition of the shunt is a significant cost item amounting to more than 10% of the magnet cost itself. Thus, there is a real need to provide intrinsically temperature stabilized permanent magnet materials.

SUMMARY OF THE INVENTION

The general object of this invention is to provide permanent magnet materials suitable for use in microwave/millimeter wave devices. A further object of the invention is to provide such materials that are characterized by high energy product and low temperature coefficient of magnetization. A still further object of the invention is to provide such materials that are characterized by a temperature coefficient low enough such that the variation of remanent magnetization is less than 2 percent over the temperature range of −50 degrees C. to 150 degrees C. A particular object of the invention is to provide such materials that will be useful in the magnetic biasing circuits of a variety of millimeter/microwave tubes.

We have now found that such permanent magnet materials can be provided by adding a heavy rare earth element alone or together with manganese to the rare earth-cobalt compound $Sm_2Co_{17}$. More particularly, the new and useful compounds of this invention correspond to the general formula $Sm_{2-x}RE_xCo_{17-y}Mn_y$ wherein RE is a heavy rare earth element selected from the group consisting of erbium, dysprosium, and gadolinium, wherein x has a value greater than zero and less than 0.7, and where y has a value less than 2.1.

DESCRIPTION OF THE PREFERRED EMBODIMENT $Sm_{1.6}Gd_{0.4}Co_{16}Mn$ is prepared by induction melting of the elements in a water cooled copper boat under a titanium gettered argon atmosphere. The sample is remelted several times to assure homogeneity. The sample is then annealed at 950 degrees C. in tantalum foil in a quartz tube under a helium atmosphere for two weeks. It is then rapidly quenched in ice water. X-ray diffraction patterns show the compound to be single phase. In the temperature range of 20 to 150 degrees C., the compound is characterized by a temperature coefficient of magnetization or $\alpha$ of −0.008%/C. and a saturation magnetization or $4\pi Ms$ of 10.5 kG.

EXAMPLE 2

$Sm_{1.6}Gd_{0.4}Co_{17}$ is prepared as in the preferred embodiment. In the temperature range of 20 to 150 degrees C., the compound is characterized by a temperature coefficient of magnetization or $\alpha$ of +0.020%/C. and a saturation magnetization of $4\pi Ms$ of 10.5 kilogauss.

EXAMPLE 3

$Sm_{1.4}Gd_{0.6}Co_{16}Mn_1$ is prepared as in the preferred embodiment. In the temperature range of 20 to 150 degrees C., the compound is characterized by a temperature coefficient of magnetization or $\alpha$ of −0.014%/C. and a saturation magnetization of $4\pi Ms$ of 10.3 kilogauss.

We wish it to be understood that we do not desire to be limited to the exact details as described, for obvious modifications will occur to a person skilled in the art.

What is claimed is:

1. A compound having the formula $Sm_{1.8}Er_{0.2}Co_{16}Mn_1$.

2. A compound having the formula $Sm_{1.6}Er_{0.4}Co_{16}Mn_1$.

3. A compound having the formula $Sm_{1.4}Er_{0.6}Co_{16}Mn_1$.

4. A compound having the formula $Sm_{1.8}Er_{0.2}Co_{15}Mn_2$.

5. A compound having the formula $Sm_{1.6}Er_{0.4}Co_{15}Mn_2$.

6. A compound having the formula $Sm_{1.4}Er_{0.6}Co_{15}Mn_2$.

7. Compounds of the general formula $Sm_{2-x}Gd_xCo_{17-y}Mn_y$ wherein x has a value greater than zero and less than 0.7, and wherein y has a value less than 2.1.

8. A compound according to claim 7 having the formula $Sm_{1.8}Gd_{0.2}Co_{17}$.

9. A compound according to claim 7 having the formula $Sm_{1.6}Gd_{0.4}Co_{17}$.

10. A compound according to claim 7 having the formula $Sm_{1.4}Gd_{0.6}Co_{17}$.

11. A compound according to claim 7 having the formula $Sm_{1.8}Gd_{0.2}Co_{16}Mn_1$.

12. A compound according to claim 7 having the formula $Sm_{1.6}Gd_{0.4}Co_{16}Mn_1$.

13. A compound according to claim 7 having the formula $Sm_{1.4}Gd_{0.6}Co_{16}Mn_1$.

14. A compound according to claim 7 having the formula $Sm_{1.8}Gd_{0.2}Co_{15}Mn_2$.

15. A compound according to claim 12 having the formula $Sm_{1.6}Gd_{0.4}Co_{15}Mn_2$.

16. A compound according to claim 12 having the formula $Sm_{1.4}Gd_{0.6}Co_{15}Mn_2$.

17. A compound having the formula $Sm_{1.8}Dy_{0.2}Co_{16}Mn_1$.

18. A compound having the formula $Sm_{1.6}Dy_{0.4}Co_{16}Mn_1$.

19. A compound having the formula $Sm_{1.4}Dy_{0.6}Co_{16}Mn_1$.

20. A compound having the formula $Sm_{1.8}Dy_{0.2}Co_{15}Mn_2$.

21. A compound having the formula $Sm_{1.6}Dy_{0.4}Co_{15}Mn_2$.

22. A compound having the formula $Sm_{1.4}Dy_{0.6}Co_{15}Mn_2$.

* * * * *